US005084322A

United States Patent [19]

Brioschi et al.

[11] Patent Number: 5,084,322

[45] Date of Patent: Jan. 28, 1992

[54] PILE FABRIC

[75] Inventors: Luigi Brioschi, Suisio; Franco La Scola, Brembate sopra, both of Italy

[73] Assignee: Quikoton AG, Glarus, Switzerland

[21] Appl. No.: 354,725

[22] Filed: May 22, 1989

[30] Foreign Application Priority Data

May 25, 1988 [CH] Switzerland ..... 01970/88

[51] Int. Cl.[5] ..... D03D 15/12

[52] U.S. Cl. ..... 428/93; 428/95; 428/85; 428/92; 428/97

[58] Field of Search ..... 428/85, 15, 623, 93, 428/95, 85, 92, 97

[56] References Cited

U.S. PATENT DOCUMENTS

| | | | |
|---|---|---|---|
| 2,656,586 | 10/1953 | Cowie et al. | 428/95 |
| 3,017,847 | 1/1962 | Keen | 428/93 |
| 4,001,477 | 1/1977 | Economy et al. | 428/224 |
| 4,871,604 | 10/1989 | Hackler | 428/95 |

FOREIGN PATENT DOCUMENTS

| | | |
|---|---|---|
| 50-0006873 | 1/1975 | Japan . |
| 57-0020423 | 4/1982 | Japan . |
| 58-0136855 | 8/1983 | Japan . |
| 59-0030935 | 2/1984 | Japan . |
| 59-0030937 | 2/1984 | Japan . |
| 60-0215857 | 10/1985 | Japan . |
| 02-2127539 | 5/1990 | Japan . |
| 2021166 | 11/1979 | United Kingdom . |
| 2179067 | 2/1987 | United Kingdom . |

*Primary Examiner*—George F. Lesmes
*Assistant Examiner*—Beverly A. Pawlikowski
*Attorney, Agent, or Firm*—Marks Murase & White

[57] ABSTRACT

A pile fabric is disclosed and claimed, comprising a ground fabric of polyester filaments and a pile of natural fibers, up to four pile picks being woven between each two adjacent weft yarns of the ground fabric. The bond of the pile picks consists at least in part of three or five warp through-pile weavings.

A special use of this fabric is an upholstery cloth for car seats and other seats of furniture.

12 Claims, 1 Drawing Sheet

PILE FABRIC

BACKGROUND OF THE INVENTION

The present invention relates to a new type of pile fabrics, also denoted as velveteen, and more particularly to a pile fabric which is extensible or stretchable to a certain extent in weft direction.

Pile fabrics are well known. They are manufactured by inserting of additional, loop forming thread systems into a ground fabric during weaving. Based on the kind of the additional threads, warp velveteens or weft velveteens can be distinguished. In weft velveteens, weaving first produces a plain fabric in that pile picks intended for the formation of floats are additionally used to the ground wefts. The pile is then obtained by subsequent cutting the floats at a point along their length so that the height of the pile corresponds to the length of the cut floats. Well known pile fabrics are plush, velvet and tufted carpets.

Covering fabrics for furniture and seating accommodations, called upholstery clothes, in particular car seats, must withstand high stresses. They are subject to specially strong stress and strain, especially to high mechanical load and high abrasion and must further be soil repelling. As a covering material, acrylic and polyamide velveteen have been found suitable where the pile picks are woven into a staple fiber ground fabric. In order to achieve the elasticity of the fabric necessary for pulling it over the corners and edges of the piece of furniture or the seat, weft and/or warp contain elastomeric fibers ("Lycra") and/or textured garns. Such a velveteen is disclosed in GB-A-2 021 166 where also a general discussion of the art of velvet manufacture, including the commonly used terms and definitions, can be found.

Such pile fabrics must generally be reinforced, as it is known from tufted carpets, by a backing layer, for example of an acrylate or polyamide binder, in order to prevent the single bound pile naps from being drawn out of the ground fabric. Such fabric are e.g. disclosed in GB-A-2 179 067.

Such pile fabrics for the use as seat cover materials, especially in car or boat seats, have disadvantages. The manufacture is difficult and expensive due to the use of elastomeric threads, even if cotton fibers are used together with elastomeric threads. Furthermore, the light fastness of the pile fabric, when dyed with dyestuffs normally used for acrylics and polyamids, is often not sufficient, as it is well known to most car drivers. Furthermore, the seating comfort is unsatisfactory due to the absolutely hydrophobic properties of the synthetic fibers and their electrostatic charge.

EP-A3-0 228 026 discloses a pile fabric which is however a warp pile material; the ground fabric contains up to 65% of cotton and is therefore not very much mechanically resistant. It is not stated whether this fabric has an elasticity in weft direction.

SUMMARY OF THE INVENTION

Therefore, a first and major object of this invention is to provide a new and useful pile fabric, well suitable for seats, especially car seats, or upholstery cloth, and which has important advantages but does not show the disadvantages of known pile fabrics.

Another object of the present invention is to provide a pile fabric of the above depicted kind which has a high service life combined with an inherent, latent elasticity without the use of elastomeric threads which, as it is well known, loose their elasticity totally or in part during use or under high strain, which lost is accompanied by undulation and wrinkle formation. In this connection, "latent" or "inherent" elasticity means that the pile fabric resiliently yields by few per cents of its dimensions—say about five, ten or fifteen per cent—on the application of a relatively high tear force.

Still another object of this invention is a pile fabric which can be dyed with high light fast and rub fast dyestuffs.

And another object of the invention is to provide a pile fabric having a better seating comfort when used as an upholstery cloth, and at the same time, a sufficient abrasion resistance.

Corduroy velvets which have first been taken into consideration could not fulfill the objects of the invention since the stretching ability of the fabric has been found to be insufficient, and the ground fabric had only low strength properties.

Now, the objects defined above and still others are attained and fulfilled by the new pile fabric which is characterized by a basic or ground fabric in linen or twill weave or in a weave construction derived from linen or twill weave, comprising polyester filament yarn for both weft and warp yarns, said ground fabric being heat set and having a latent elasticity at least in the weft direction by pile yarns consisting for at least a major part of natural fibers; by up to four pile picks inserted between two adjacent ground weft yarns, at least part of said pile picks are present as a W-bound pile naps in three or five warp through-pile construction.

The pile fabric of the invention is heat set in such a manner that it obtains a latent elasticity. Heat setting of polyester filaments is a simple and well known technique. The ground fabric comprises up to four pile picks between two successive ground picks. The pile picks are typically not fully staggered—or not at all—and they are at least in part present in three or five -warp through-pile construction, thus as pile naps in W-binding. They consist in their major part or in totality of natural fibers such as staple fibers of cellulose, especially cotton.

Up to four pile picks may alternate with one ground weft yarn. In this specification, "pile yarns" or "pile picks" will denote the pile-forming weft yarns whereas the yarns in the basic or ground fabric are called "ground yarns". The term "ground fabric" does not design a ground fabric wherein pile yarns are tufted—this is a method which could in principle also be used to manufacture the fabric of this invention—but denotes the fabric which would remain if all pile yarns were eliminated.

When a ratio of one pile pick to one ground yarn is selected, a very dense pile fabric is obtained. When more than four pile picks are used to one ground weft, the strength of the ground fabric will not be sufficient. Two pile picks between two successive ground wefts are therefore preferred.

The three or five warp through-pile weaving of the pile picks which will in detail be explained later, may be distributed at will throughout the fabric and may be combined with one warp pile-up bond (or V bond). The through-pile bond gives a particularly strong fixation in the ground fabric, and these piles cannot be pulled out. A special adhesive backward coating is not necessary.

The three warp through-pile weaving of the pile fabric may be described as follows (see also FIG. 2) if a section of the pile fabric from left to right is considered, and the pile pick is followed:

cut float —under one warp yarn—over one warp—under one warp—cut float, etc. ($W^3$).

The five warp through-pile weaving can be represented as follows:

cut float—under two warps—over one warp—under two warps—cut float, etc. ($W^5$), whereas the one warp pile-up binding, as known, goes only once under one warp and forms a V nap.

The invention provides a new upholstery cloth for seats which combines the advantages of the natural fiber cotton, i.e. in particular its seating comfort and the light fast dyeability, with the strength values of a polyester filament ground fabric in strong weaving.

The backside of the new pile fabric may remain unchanged. It may, however, also be provided with a back coating layer adapted to the field of use. This back coating must have the same as or a higher stretch than the pile fabric. Elastomeric coatings, e.g. with foams, fulfill this condition.

The pile fabric of this invention must have a sensible, although relatively low stretch of about five, ten or fifteen per cent, denoted as linear reversible elongation at least in weft direction. This may advantageously be achieved by weaving the fabric with a low a weft yarn tension as possible, and then heat setting this loose fabric. If a stretch also in warp direction is wanted, low textured warp yarns should be used, or the fabric will be heat set under negative tension, e.g. under overfeed or advance in the center frame.

The polyester yarns of the ground fabric are high strength filament yarns. They consist of a multitude of endless fibrils combined into a cable. They can be dyed, the best in the spinning melt. Double strands of two filaments are preferred which are spin-dyed with some carbon black and twisted with low drill. On spin dyeing, other additives known per se may be added, e.g. fire retarders, plastizisers, etc.

The pile yarns consist preferably of cotton. However, wool or silk yarns or mixed fiber yarns may be used whose major component is a natural fiber. They are dyed, as usual, with light fast dyestuffs, e.g. reactive or metal complex dyes.

The nature, amount and distribution of the pile yarns introduced during weaving will determine the hand, the density and the design of the pile. These conditions are known to the man skilled in the art, also regarding the pile height. The fabric i woven with a high warp density in order to improve the stretch in weft direction.

An elegant possibility to achieve a stretch in all directions of the plane is the use of a very dense knitted fabric as a ground substrate.

A preferred embodiment of the pile fabric of this invention will now be described with reference to the drawing. It will be understood that the invention is not limited by the following detailed description, but modifications and variations thereof may occur to one skilled in the art as being comprised in the scope of the invention as defined by the appended claims.

DESCRIPTION OF AN EMBODIMENT OF THE INVENTION

Figure 1:
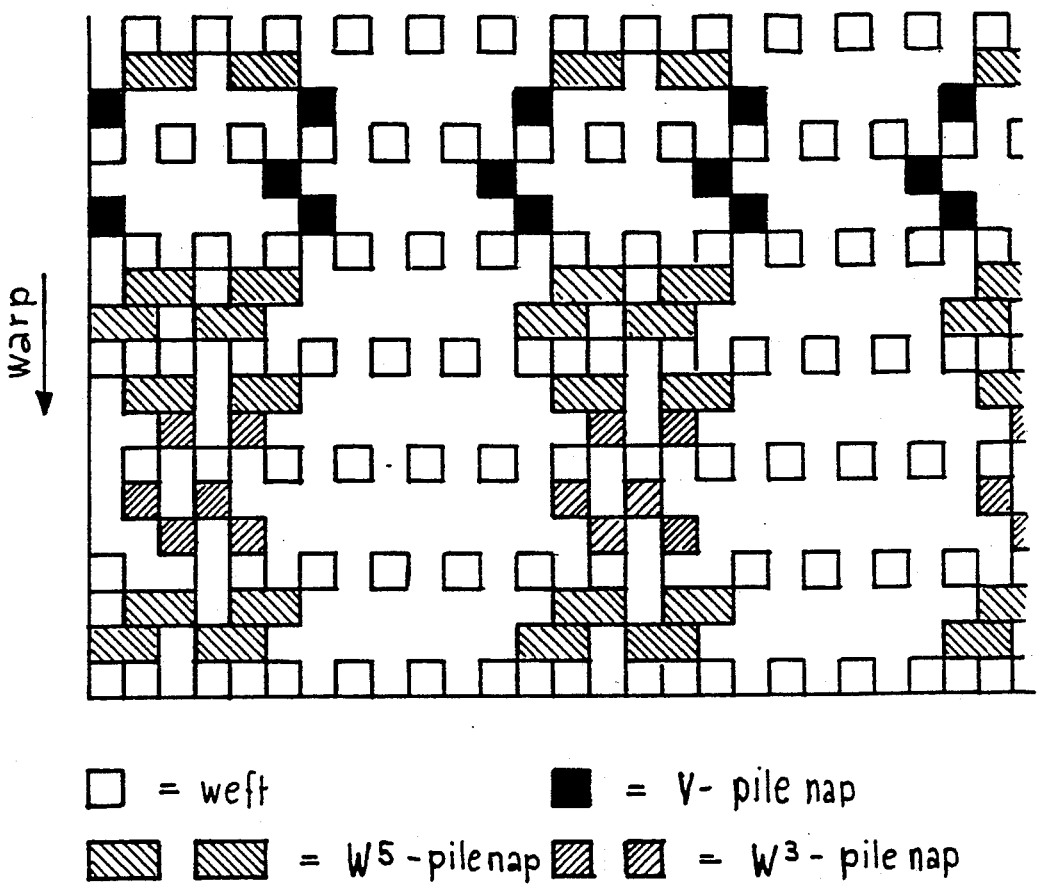
FIG. 1 shows a conventional diagram, namely a point paper design, of the fabric, seen from the back, and FIG. 2 the binding of the pile picks.

In FIG. 1, the warp is shown from above to below, and the particular warp yarns are not denoted. Twelve weft yarns S are shown as black squares. At the lower end of the diagram, the beaming repeat starts again, and also to the right. Between two weft yarns, pile picks are woven in regular spacing, namely (a) as a five warp through-pile and one warp pile-up bond (as $W^5$ and V), (b) as a one warp pile-up bond (V), (c) as a repeat of five warp through-pile bonds ($W^5+W^5$), or (d) as a repeat of three warp through-pile bonds ($W^3+W^3$).

Other combinations are of course possible.

The $W^5$ pile naps are represented by squares hatched from left above to right below, the $W^3$ pile naps from right above to left below, and the V naps are black squares.

Figure 2:
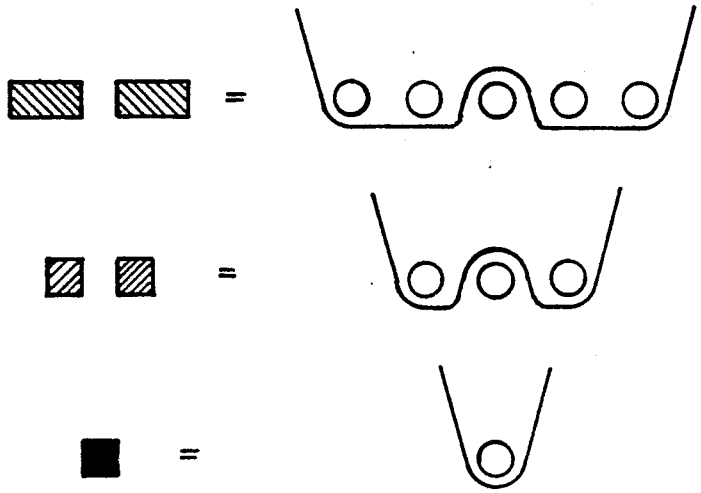

The weaving species can be seen on FIG. 2 where the warp yarns are shown in section. The pile picks are represented as being cut between every two successive floats.

The five warp through-pile bond is firmly held by underleading under two warp yarns at both sides of one warp yarn, with which the pile pick does not form a loop but with which it is in firm contact. A strong but simpler bond is the $W^3$-bond (FIG. 2) whereas the simple V-bond which contributes tot he pile density, is also shown in FIG. 2.

EXAMPLE

A pile fabric whose point paper design is shown in FIG. 1, was manufactured from 100% polyester filament yarn for weft and warp, having a titer of 107/48×2 dtex, S-twist 250 per meter, and from blue dyed cotton pile yarns. The pile fabric thus obtained had a pleasant, non-skid pile surface showing good humidity, absorption, and the ground fabric had a reversible stretch in weft direction of about 10%. The backside gave the impression of a honeycomb design.

The pile fabric of the invention is first treated by caustic soda solution at 130° to 140° C. and then finished in the same manner as corduroy velvet. After cutting the pile floats, the fabric is brushed, bleached, washed, the cotton fibers are dyed, the fabric is anew washed and then dried. In most cases, a soil repelling finish is then applied. The backside is optionally coated or laminated to other web materials.

We claim:

1. A pile fabric consisting of a fabric and of pile forming weft yarns having a fabric woven in linen or twill weave comprising polyester filament yarns for both weft and warp, said fabric being heat set and having a stretch elasticity at least in the weft direction;

pile pick yarns consisting primarily of natural fibers;

one to four pile picks inserted between every two adjacent ground weft yarns, at least part of said pile picks being bound as three or five warp through-pile weavings forming $W^3$ and $W^5$ pile naps, respectively.

2. The pile fabric according to claim 1, having a fabric wherein warp and weft are spun-dyed polyester filament yarns.

3. The pile fabric according to claim 1 or 2 further having elasticity in the warp direction based on the use of low textured yarns or warp yarns set under negative tension.

4. The pile fabric according to claim 1 having pile yarns consisting primarily of cotton.

5. The pile fabric according to claim 1 further having an extensible backing layer whose stretch is at least equal to that of the pile fabric.

6. A seat cover and upholstery fabric, comprising a fabric with weft and warp yarns and having pile forming weft yarns, said fabric being in linen or twill weave and further having pile pick weft yarns inserted between every two adjacent ground weft yarns, at least part of the pile picks being bound as through-pile weavings, wherein said fabric comprises warp and weft yarns of spun-dyed polyester filament yarns, said fabric having an elasticity at least in the weft direction by the use of textured polyester filament yarns at least as weft yarns, and that said pile pick weft yarns are of cotton, from one to four pile pick weft yarns being inserted between every two adjacent ground weft yarns and forming W3 and W5 pile naps, respectively.

7. The fabric of claim 6, wherein said elasticity results in a reversible stretch of the fabric of up to 15% in elongation.

8. The fabric of claim 6 wherein said elasticity results in a reversible stretch of the fabric of about 10% in elongation.

9. The fabric of claim 6, wherein said elasticity results in a reversible stretch of the fabric of about 5% in elongation.

10. The fabric of claim 6, wherein the fabric has an elasticity of up to 15% in elongation also in the warp direction.

11. The fabric of claim 6, wherein the fabric textured polyester filament yarns are fixed by heat-setting of the fabric.

12. The fabric of claim 7, wherein the fabric is further provided with an extensible backing layer whose stretch is equal to or greater than that of the fabric.

* * * * *